United States Patent [19]

Thuries et al.

[11] Patent Number: 4,568,808

[45] Date of Patent: Feb. 4, 1986

[54] TELESCOPIC ISOLATING SWITCH

[75] Inventors: Edmond Thuries, Pusignan; Jean-Paul Masson, Villeurbanne; Louis Malik, Caluire, all of France

[73] Assignee: Alsthom-Atlantique, France

[21] Appl. No.: 692,452

[22] PCT Filed: Apr. 27, 1984

[86] PCT No.: PCT/FR84/00117

§ 371 Date: Dec. 19, 1984

§ 102(e) Date: Dec. 19, 1984

[87] PCT Pub. No.: WO84/04424

PCT Pub. Date: Nov. 8, 1984

[30] Foreign Application Priority Data

Apr. 29, 1983 [FR] France ..... 83 07099

[51] Int. Cl.[4] ..... H01H 31/00

[52] U.S. Cl. ..... 200/48 V; 343/901

[58] Field of Search ..... 200/48 V; 343/901; 52/118, 121

[56] References Cited

FOREIGN PATENT DOCUMENTS 0070248 1/1983 European Pat. Off. .
1074115 1/1960 Fed. Rep. of Germany ... 200/48 V
1077748 3/1960 Fed. Rep. of Germany .
1131296 6/1962 Fed. Rep. of Germany ... 200/48 V
2501408 9/1982 France .

*Primary Examiner*—Stephen Marcus
*Assistant Examiner*—Renee S. Kidorf
*Attorney, Agent, or Firm*—Sughrue, Mion, Zinn, Macpeak, and Seas

[57] ABSTRACT

This telescopic isolating switch is made from nestable tubular members (10, 11', 12') including a base member (10) connected to an electrical connection point, intermediate members (11', 12'), and an end member supporting an electrical contact. Each intermediate member (11', 12') contains two pulley wheels (110, 111) fixed close to respective ends thereof, together with an endless loop (114) passing over the two pulley wheels (110, 111) inside the member and attached at two diametrically opposite points (116, 117) to the ends of the two adjacent members (10, 12'). The lower pulley wheel (110) of the intermediate member (11') which is adjacent to the base member (10) being driven through the base member (10) by means of a gear system slidingly engaged on a rotary fluted shaft (104) which is fixed inside the base member (10) and which is driven by a drive motor.

13 Claims, 16 Drawing Figures

TELESCOPIC ISOLATING SWITCH

The present invention relates to a telescopic isolating switch for connecting equipment to an overhead conductor.

Various sorts of isolating switch are known comprising a plurality of tubular conductor members nested inside one another and enabling a fixed contact carried on an overhead conductor to be reached (closed position) or to be kept at a distance (open position), depending on whether the nested tubes are in a deployed position or in a retracted position.

The present invention is related more particularly to the manner in which the various tubular conductors are mechanically driven to enable the isolating switch to pass, when operated, from the switch open position when the conductors are practically completely nested inside one another, to the switch closed position when they are nearly end-to-end.

Some prior art isolating switches use a rigid insulating rod which is inserted from the base through an isulating support into the nested conductor members, and is fixed to the top of the last member which has the contact point, the rod is pushed or pulled by a motor which is placed at ground potential for deploying or retracting the tubular members. These switches have the drawback of an insulating support which is necessarily hollow, thus running the risk of internal arcing due to condensation water. Other isolator switches avoid this risk by having a flexible insulating rod which is bent out through the base of the last telescopic member above the insulating support which is solid. This flexible rod runs the risk of buckling when it is pushed up inside the telescopic members and it must be laterally guided which leads to an increased number of moving parts inside the telescopic members. It must also be rolled up outside the telescopic members when they are retracted which considerably increases the ground space taken up by the isolating switch.

The aim of the present invention is a telescopic isolating switch which can be mounted on a solid insulating support that does not run the risk of arcing due to condensation water and which has a simple mechanism which is housed inside the telescopic members for the most part and which takes up little ground space.

The present invention provides a telescopic isolator switch made up of nestable tubular members comprising a base member connected to an electrical connection point, intermediate members, and an end member bearing an electrical contact. Each intermediate member of the isolating switch contains two pulley wheels, one fixed close to each end thereof, and an endless loop passing over the two pulley wheels inside the member and attached at two diametrically opposite points to the ends of the two adjacent members. Mechanical means displace the intermediate member adjacent to the base member.

These mechanical means advantageously comprise a gear system which drives one of the pulley wheels of the intermediate member adjacent to the base member, and which slidably engages a rotary fluted shaft which is fixed inside the base member parallel to one of its generator lines.

In a variant, the mechanical means may be formed by a hollow screw and nut system.

In a preferred embodiment, the nestable tubular members of the isolator switch are each provided with a socket at their ends pointing towards the base member. The socket of each intermediate member supports a length of rod which is placed inside the corresponding member and which has the pulley wheels fixed to the ends thereof. The socket of the base member and the sockets of each intermediate member that is not adjacent to the end member also support respective posts placed inside the corresponding member and which is attached at its other end to the endless loop of the adjacent member next closer to the end member. The sockets of the end member and of the intermediate members are attached to the endless loop of the adjacent member next closer to the base member.

The endless loops are preferably made of chain.

The deployment and retraction mechanism made in this way has very few sliding parts, with the majority of its movements being rotary. It is also entirely lodged inside the tubular members of the isolating switch when in the retracted position, thereby greatly reducing the ground space required.

Other characteristics and advantages of the invention will appear from the accompanying claims and from the following description of an embodiment given by way of example. The description is made with reference to the drawings, in which:

DESCRIPTION OF THE PREFERRED EMBODIMENTS

Figure 1:
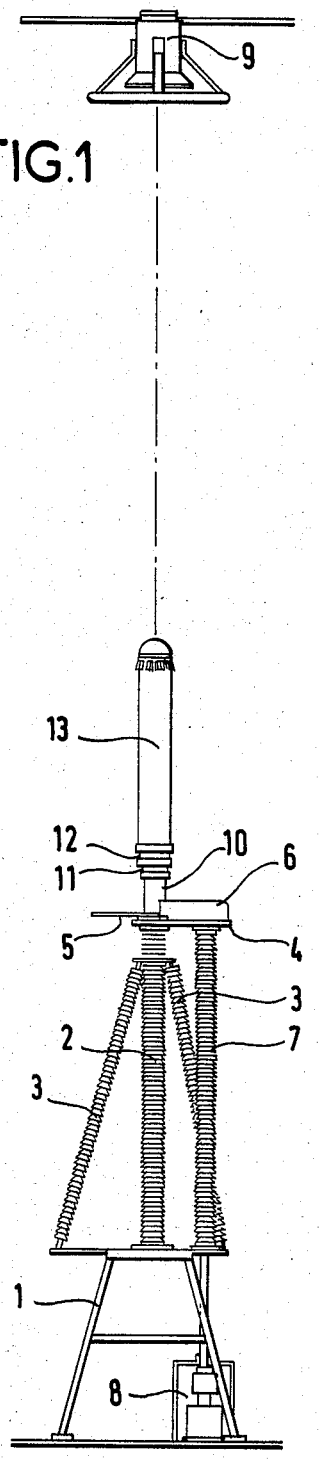
FIG. 1 is a front view of a telescopic isolating switch in accordance with the invention and in the open position.
Figure 2:
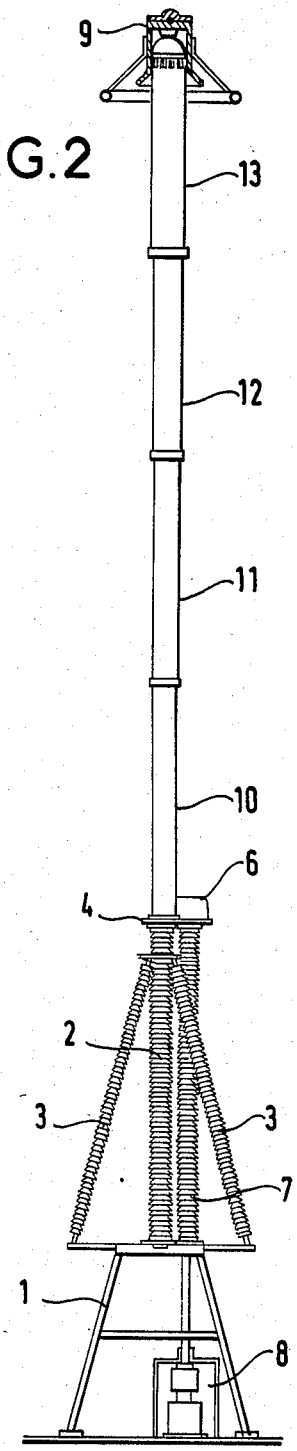
FIG. 2 is a side view of the same switch in the closed position.

FIG. 1 shows a telescopic isolating switch in the open position. It comprises a metal stand 1 placed on the ground and supporting an insulating ceramic column 2 held in place by insulating stays 3. A platform 4 is fixed to the top of the insulating column 2 and receives: the bottom of a base tubular telescopic member 10; its electrical connection point 5; and a mechanical coupling box 6 which is connected to the the end of a rotary drive shaft 7 which is vertical, insulating, and extends the axis of a drive motor reduction unit 8 placed on the ground. The coupling box 6 encloses a chain transmission which links in rotation the insulating shaft 7 and a fluted shaft placed inside the base tubular telescopic member 10.

The tubular telescopic member 10 is capped by three other tubular members 11, 12, and 13 which are nested on one another. The top member 13 is terminated by a contact for co-operating which a contact 9 of complementary shape fixed to an overhead line.

Figure 3:
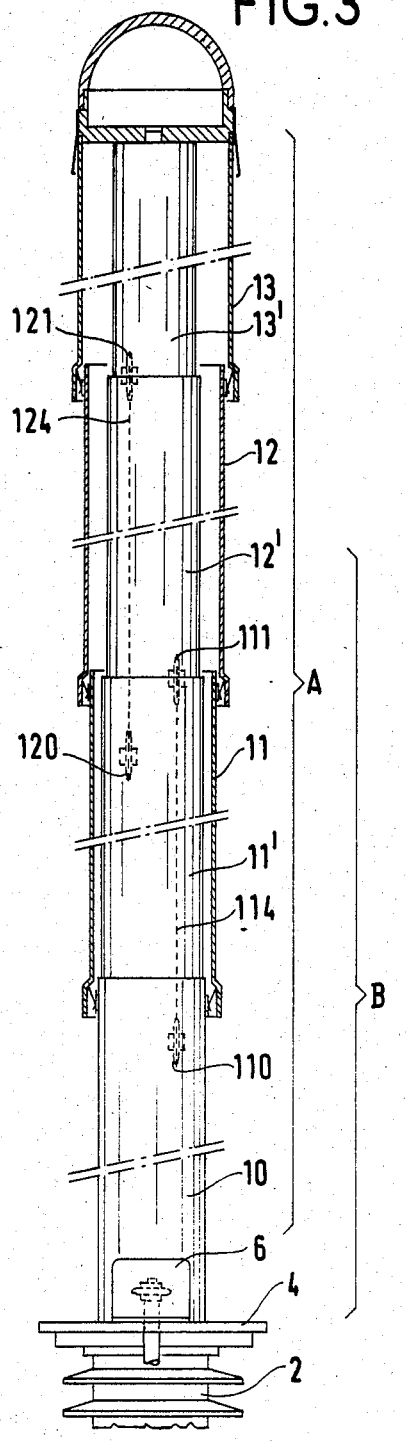
FIG. 3 is a partially cut-away view of the telescopic members in the deployed position.

The tubular telescopic members 10, 11, 12, and 13 are disposed in such a manner that they are of decreasing diameter from the top downwards so as to avoid rain water penetrating into the apparatus. They are electrically conductive and they are provided with contact rings around the peripheries of their bottom ends and inside protective covers. They constitute a first telescopic system whch serves solely as an electrical conductor and which rests on a second telescopic system which is coaxial and which encloses the deploying and retracting mechanism. This mechanical second telescopic system is visible in FIG. 3 and comprises a tubular base member 10 which is common to the first telescopic system, intermediate tubular members 11' and 12', and an end member 13' which are of the same lengths as the members of the first system, but which are of decreasing diameter from the bottom upwards.

Figure 3A:
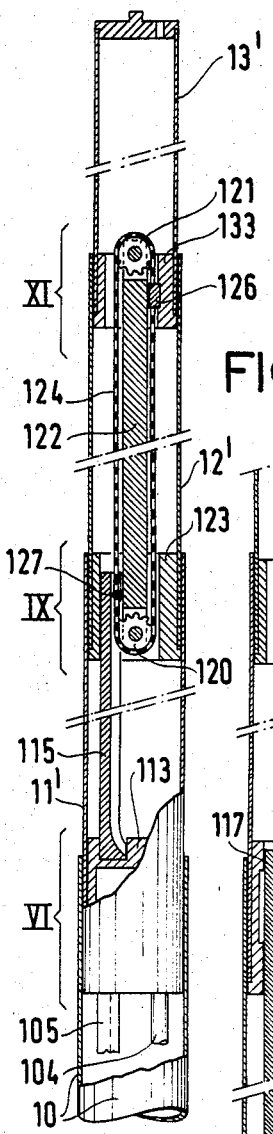
FIGS. 3A and 3B are diagrams of the mechanisms interconnecting the movements of the telescopic members relative to their immediate neighbors.
Figure 3B:
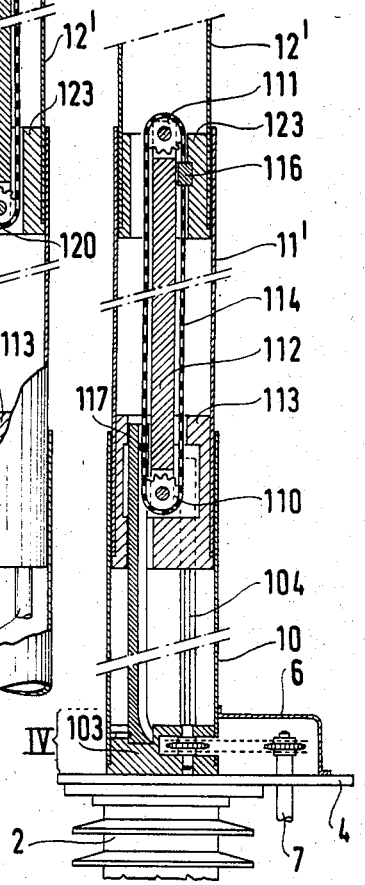

The intermediate member 12' of the mechanical telescopic system includes a chain mechanism shown in FIG. 3A which links the movements relative thereto of the two adjacent tubular members 11' and 13'. The intermediate tubular member 11' of the mechanical telescope includes another similar chain mechanism shown in FIG. 3B linking the movements relative thereto of the two adjacent tubular members 10 and 12'. In addition to these two chain mechanisms which link the relative movements of the various telescopic tubular members, there is a mechanical drive system for driving the bottom pulley wheel of the chain mechanism in the lower intermediate member 11' by means of a system of gears sliding on a rotary fluted shaft which is fixed vertically inside the base member 10.

The chain mechanisms of the intermediate members 12' and 11' comprise two pulleys 120, 121 (or 110, 111) placed inside the respective member at the ends of a vertical rod 122 (or 112) which is fixed at one end to a socket 123 (113) which is received in the bottom end of the respective member. An endless loop of chain 124 (114) runs over the two pulley wheels 120, 121 (110, 111) in each member 12' (11') and the chains are attached at diametrically opposite points to each of the adjacent members. In the case of the intermediate member 12', one side 127 of the the chain 124 is attached to the top of a vertical post 115 whose other end is engaged in the socket 113 of the intermediate member 11'. The diametrically opposite position on the other side of the chain has a lug 126 which is held captive in a socket 133 which is received in the bottom of the top member 13'. In the case of the intermediate member 11', one side 117 of the the chain 114 is attached to the top of a vertical post 105 whose other end is engaged in a base plate 103 received in the bottom of the base member 10. The diametrically opposite position on the other side of the chain has a lug 116 which is held captive in the socket 123 in the member 12'.

The socket 113 received at the bottom end of the intermediate member 11' encloses a system of gears that is slidable along a rotary fluted shaft 104 which it links in rotation with the pulley wheel 110 of the chain mechanism. The fluted shaft 104 runs parallel to a generator line inside the base tubular member 10 and is fixed at one end to rotate in the base plate 103 where it is driven by a toothed wheel 108 placed at the end thereof and engaging a chain 109 from the coupling box 6.

Turning on the motor 8 causes the fluted shaft 104 to rotate inside the base tubular member 10 and drives the chain 114 by means of the gear system and the pulley wheel 110. Since the chain 114 is attached to the fixed post 105, the moving equipment constituted by the pulley wheels 110 and 111 is caused to move therealong, and consequently the intermediate member 11' on which they are mounted is made to move relative to the base member 10. Likewise, the intermediate member 12' is driven by the lug 116 on the chain 114 in a movement which is in the same direction and of the same amplitude relative to the intermediate member 11'. This second movement drives the moving equipment constituted by the pulley wheels 120 and 121 as the chain 124 along the post 115 and consequently causes the top member 13+ to be driven in the same direction and with the same amplitude relative to the intermediate member 12' by means of the lug 126 on the chain 124. The motor 8 thus drives the assembled telescopic tubular members 10, 11', 12', and 13' to move them in the same direction and with same amplitude relative to one another, thereby deploying or retracting the isolating switch.

The two chain mechanisms of the intermediate telescopic members 11' and 12' occupy complementary longitudinal half sections of the isolating switch so as to be housed side-by-side inside the base member 10 when the switch is retracted. The fluted shaft 104 is to one side in a space left free by the chain mechanisms where the two half sections meet.

Figure 5:
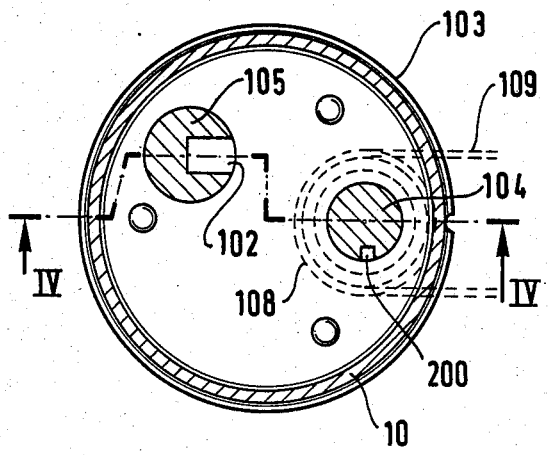
FIGS. 4 to 12 are sections through various portions of the telescopic members in the deployed position.
Figure 4:
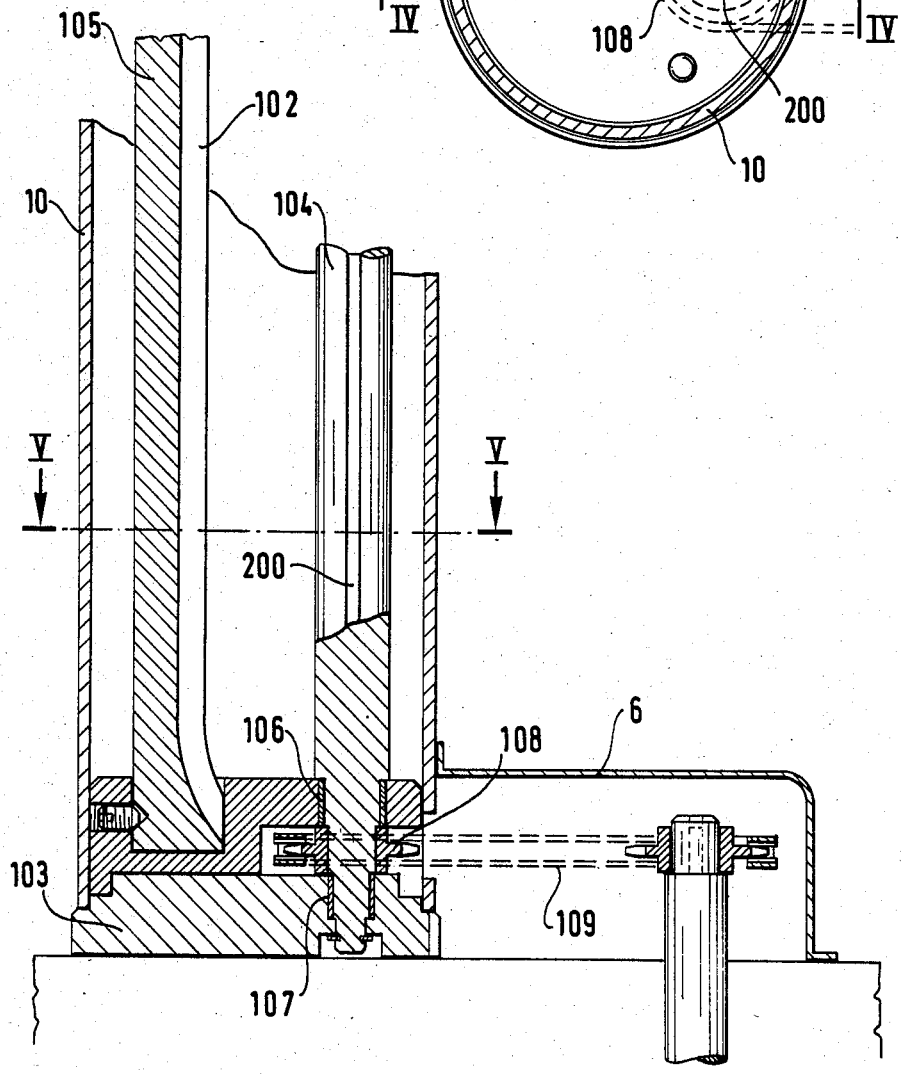

The structure of the isolating switch at the base plate 103 of the base member 10 is shown in detail in FIGS. 4 and 5, in which the FIG. 4 is a longitudinal section on a broken line IV—IV in FIG. 5, and in which FIG. 5 is a cross section on a line V—V in FIG. 4. The end of the rotary fluted shaft 104 is fixed in the base plate 103 by two bearings 106 and 107 placed on either side of the toothed wheel 108 which is driven by the chain 109 from the coupling box 6. The post 105 is inserted in the base plate 103 and is screwed therein. It is of circular section and has a longitudinal groove 102 in which the chain 114 of the first intermediate telescopic member 11' is guided.

Figure 6:
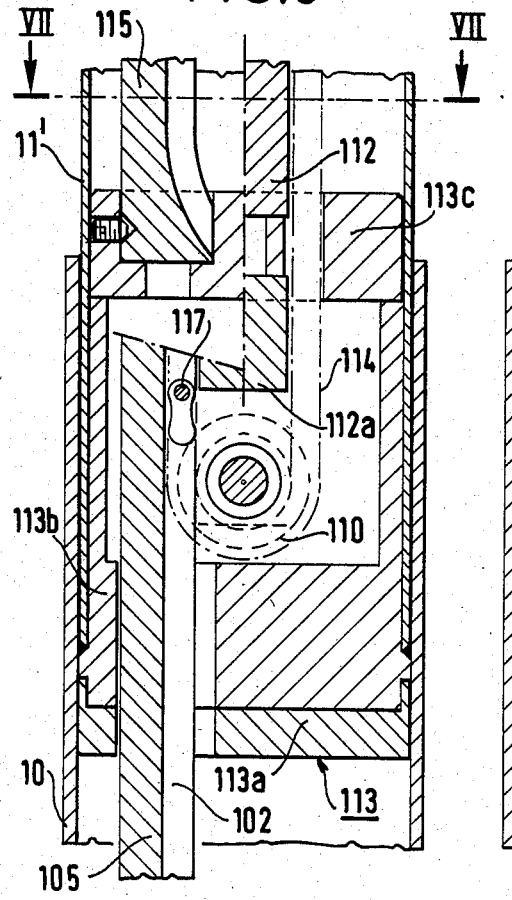
Figure 8:
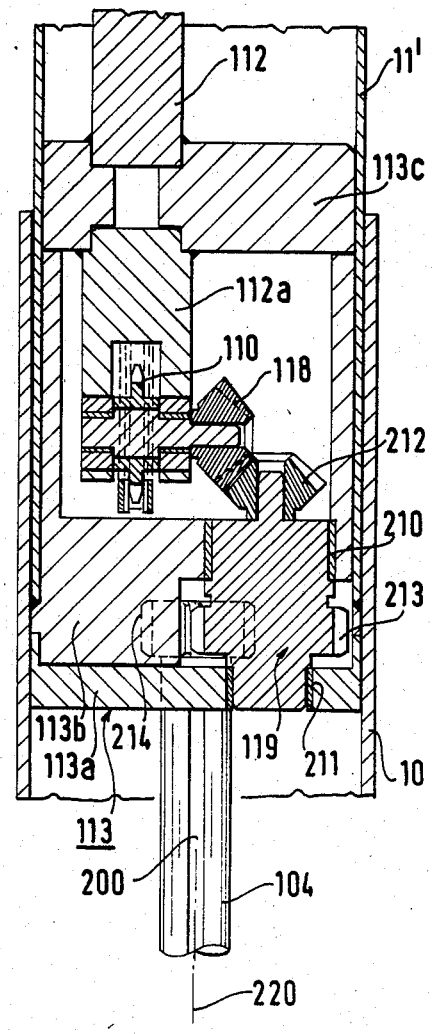
Figure 7:
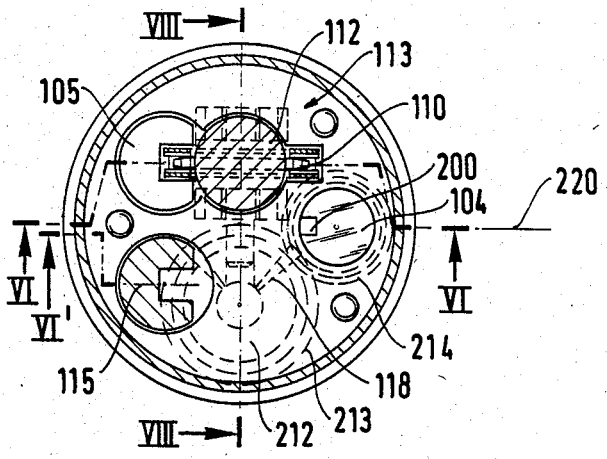

The structure of the isolating switch around the socket 113 of the first intermediate telescopic member 11' is shown in detail in FIGS. 6, 7, and 8.

FIG. 6 is a longitudinal section on a broken line VI—VI of FIG. 7 and its top left hand corner corresponds to a partial section on line VI' of FIG. 7. These longitudinal sections are parallel to the planes of the chains and show: the bottom pulley wheel 110 of the mechanism of the first intermediate telescopic member 11'; the vertical rod 112 which supports the pulley wheel 110 by its bottom extension **112*a*, and which is fixed close to its bottom end to a portion c of the socket 113 which is made in three parts a, b, and c; the free to end of the post 105 whose bottom end is fixed in the base plate 103 of the base telescopic member 10, which free top end passes right through the socket 113; the point 117 where the free end is attached to the chain 114; and in another plane, the bottom end of the post 115 fixed to the socket 113**.

FIG. 8 is a longitudinal section in a plane perpendicular to FIG. 6 on a line VIII—VIII of FIG. 7 and passing through the axis of the bottom pulley wheel 110 of the chain mechanism of the first intermediate telescopic member 11'. It shows the gear system which transmits rotary drive to the bottom pulley wheel 110 from the fluted rotary shaft 104, thereby transmitting drive from the motor 8 through the base telescopic member 10. This gear system comprises a 45° bevel gear wheel 118 mounted on the end of the shaft of the pulley wheel 110, and a transmission gear 119 mounted vertically in the socket 113 in bearings 210, 211 and having a 45° bevelled first toothed portion 212 placed at the end thereof and co-operating with the bevel wheel 118 and a cylindrical second toothed portion 213 placed between the two bearings 210 and 211 and engaging a gear wheel 214 which is slidably mounted on the fluted shaft 104, which is driven thereby via a finger which slides in the groove 200 and which is held captive in the socket 113 by two plate 113*a* and 113*b*.

FIG. 7 is a cross section on a line VII—VII of FIG. 6 which shows more particularly the lateral disposition of the chain mechanism of the intermediate telescopic member 11' in one longitudinal half section of the telescopic members leaving the complementary half section free to house the chain mechanism of the second intermediate telescopic member 12'. The chain mechanism of the first intermediate telescopic member 11' appears above the center line 220 together with the vertical rod 112 for supporting both pulley wheels 110 and 111, and the bottom pulley wheel 110. The fluted shaft 104 passes through the socket 113 via an opening placed to one side of the center line 220. The gear system appears essentially below the center line 220: ie. the gear wheel 118 on the axis of the pulley wheel 110; the transmission gear 212; and the gear wheel 214 on the fluted shaft 104. FIG. 7 also shows the lateral emplacement of the post 105 which is fixed to the base telescopic member 10 and which has its free end passing through the socket 113 above the center line 220 along one of the sides of the chains 114 to which it is attached. The figure also shows the lateral emplacement of the post 115 which is fixed to the socket 113 and appears below the center line 220 in the area reserved for chain mechanism of the second intermediate telescopic member 12'.

Figure 9:
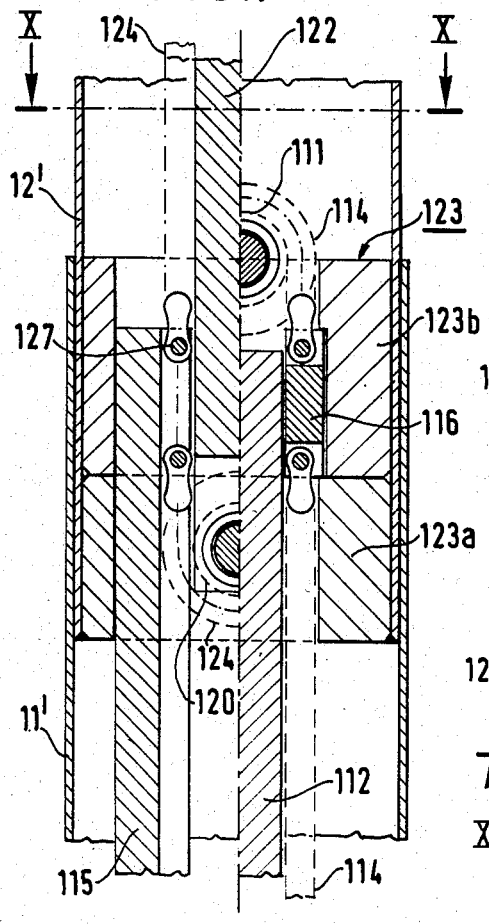
Figure 10:
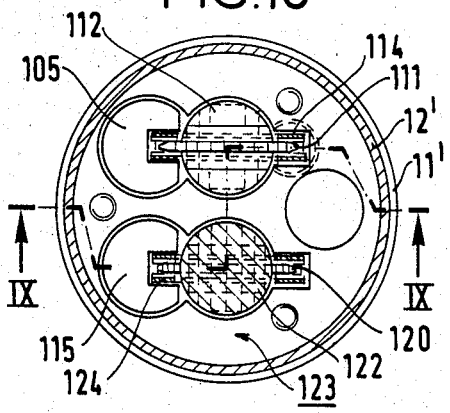

The structure of the isolating switch in the vicinity of the bottom socket 123 of its second intermediate telescopic member 12' is shown in detail in FIGS. 9 and 10, of which FIG. 9 is a longitudinal section on a broken line IX—IX of FIG. 10 and FIG. 10 is a cross section on line X—X of FIG. 9. The top of the rod 112 supporting the pulley wheel 111 of the chain mechanism of the first intermediate telescopic member 111' passes through an opening in the socket 123. The chain 114 of this mechanism carries the drive lug 116 which is held captive in the socket 123 which is in two parts 123*a* and 123*b*. The bottom end of the rod 122 supporting the bottom pulley wheel 120 of the chain mechanism of the second intermediate telescopic member 12' is fixed to the socket 123. The chain 124 of this second mechanism is attached at 127 to the free end of the post 115 which passes right through the socket 123. The plan view of FIG. 10 clearly shows the side-by-side disposition of the two chain mechanisms of the two intermediate telescopic members 11' and 12'.

Figure 11:
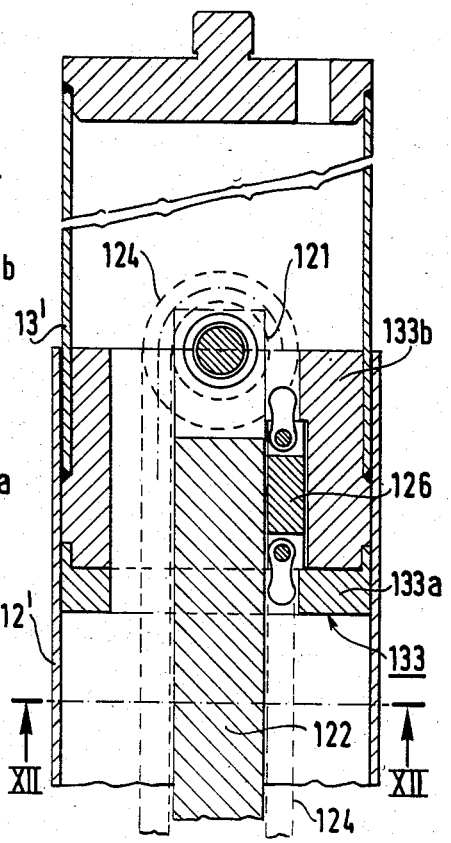
Figure 12:
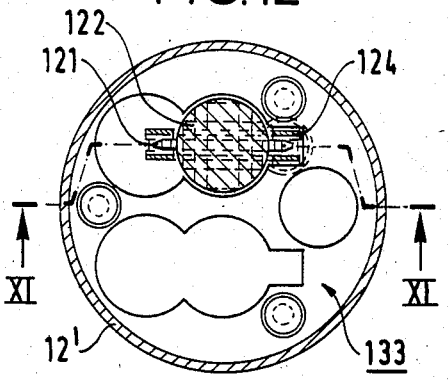

The structure of the isolating switch in the vicinity of the bottom socket 133 of its top telescopic member 13' is shown in detail in FIGS. 11 and 12, of which FIG. 11 is a longitudinal section on a line XI—XI of FIG. 12 and FIG. 12 is a cross section seen from above on line XII—XII of FIG. 11. The tops of the rods 112 and 122 supporting the pulley wheels of the chain mechanisms of the first and second intermediate telescopic members 11' and 12' together with the tops of the posts 105 and 115 pass through the socket 133. The drive lug 126 of the chain 124 of the mechanism of the second intermediate telescopic member 12' is held captive in the socket 133 which is in two parts 133*a* and 133*b*. FIG. 12 shows more particularly the various cutouts in the socket 133.

It is possible, without going beyond the scope of the present invention to modify certain dispositions or to replace certain means by equivalent means. In particular, the fluted shaft and the gear system transmitting the movement of the drive motor to the chain mechanism of the first intermediate telescopic member may be replaced by a hollow screw and nut system, the base telescopic member then housing a hollow screw which is driven in rotation by the drive motor, and the socket of the first intermediate telescopic member being fixed to a nut which moves inside to hollow screw.

A chain system may also be used to drive the lower tube 11'.

Figure 13:
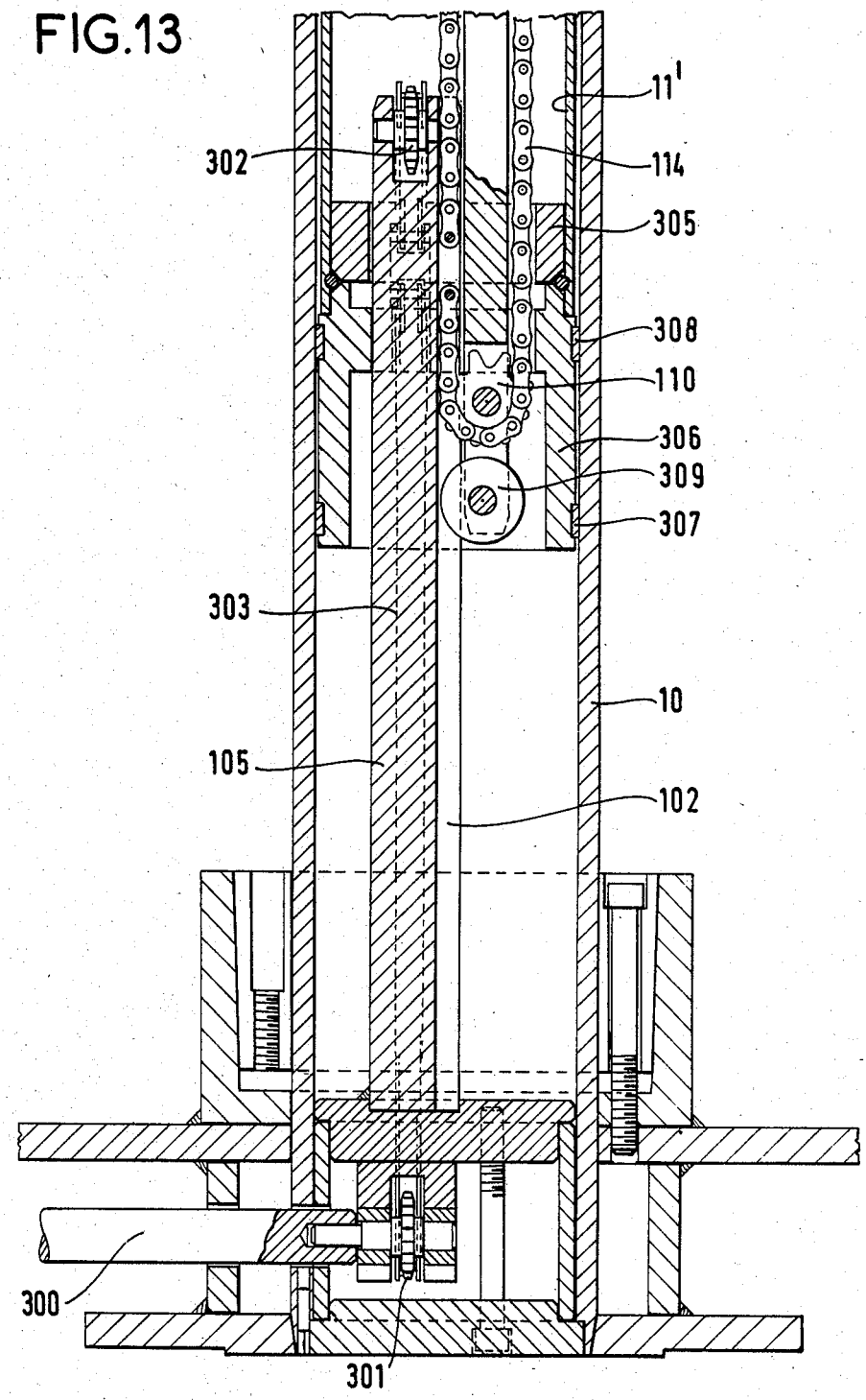
FIG. 13 is an axial section through a portion of the bottom mechanical telescopic member having a variant drive mode.

FIG. 13 shows a variant embodiment of an isolating switch in accordance with the invention, in which the bottom mechanical telescopic member 11' is driven by an endless chain 303 rotating over two toothed wheels 301 and 302. The wheel 301 is driven by a shaft 300 which is connected by a universal joint system to the shaft 7 (see FIG. 3A).

The chain 303 drives a block 305 which is linked to the chain 114. The block 305 is associated with a guide block 306 provided with slip rings 307 and 308.

Reference 309 designates a pulley wheel for guiding the chain 114 in the groove 102 of the post 105.

Figure 14:
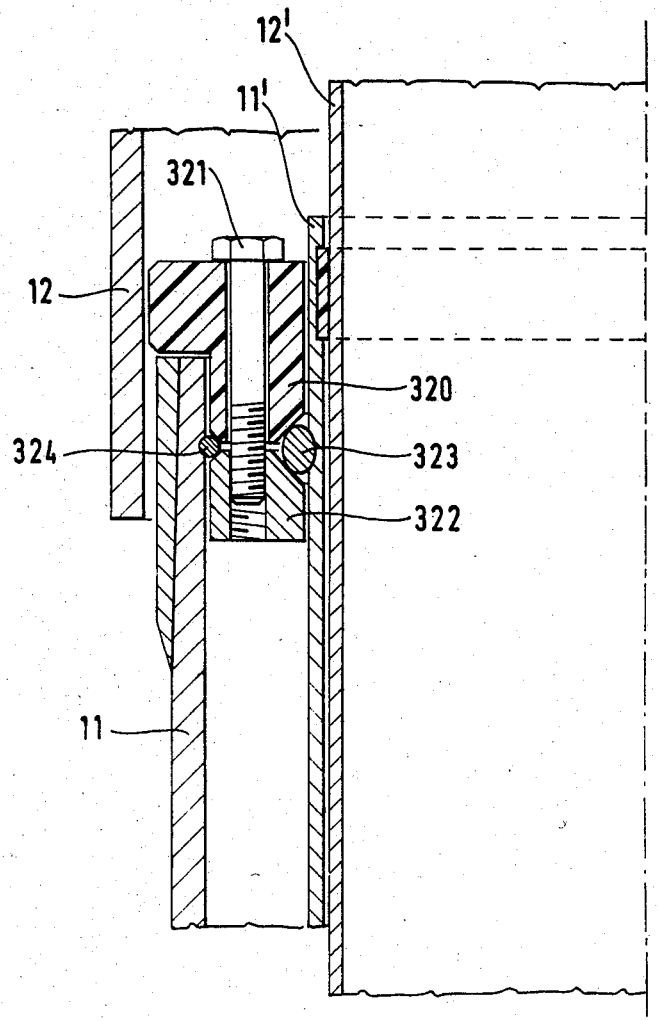
FIG. 14 is an axial section through a portion of one mode of fixing an electrical telescopic member to an adjacent mechanical telescopic member.

FIG. 14 shows one way of fixing the outer current passing tubes to the inner drive tubes.

The outer tube 11 is fixed to the tube 11' by means of metal bands 323, 324 which are held by an assembly comprising two rings 320, 322 and screws such as 321.

We claim:

1. In a telescopic isolating switch having a base conductor tube (10) connected to an electrical connection point (5), intermediate conductor tubes (11, 12) and an end conductor tube (13) bearing an electrical contact, means for nestably mounting said tubes in one another for retracting said tubes as the isolating switch moves to a retracted position, the improvement comprising:

deployment and retraction means of the isolating switch comprising a set of telescopic members including said base conductor tube (10), intermediate tubular members (11', 12') in equal numbers to the conductor tubes, and an end tubular member (13');

mechanical displacement means for displacing the intermediate member (11') which is adjacent to the base member (10); and mechanical link means associated with each intermediate tubular member (11', 12') for linking the movements of the corresponding intermediate tubular member relative to the tubular members adjacent thereto, and comprising, in each intermediate tubular member (11', 12'), two pulley wheels (110, 111 or 120, 121), each fixed for rotation about its axis in the proximity of a respective end of the associated intermediate tubular member, together with an endless loop passing over the two pulley wheels (110, 111 or 120, 121) and means for mechanically attaching said endless loop at two diametrically opposite points (116, 107 or 126, 127) to the ends of the tubular members that are adjacent to the associated tubular member.

2. An isolating switch according to claim 1, wherein the endless loop is a chain (114, 124).

3. An isolating switch according to claim 1, wherein the mechanical displacement means comprises a hollow screw placed inside the base member and driven by a drive motor, and a nut movable in the hollow screw and fixed to the intermediate member adjacent to the base member.

4. An isolating switch according to claim 1, wherein each of the intermediate members (11', 12') includes a socket (113, 123) fixed at its end nearest to the base member (10) to said intermediate member, respectively, and a rod (112, 122) which is placed inside and parallel to a generator line, with one end fixed to the socket (113, 123) and with the pulley wheels (110, 111 or 120, 121) fixed to the ends thereof for rotation about the pulley axis.

5. An isolating switch according to claim 1, wherein said tubular members comprise four nestable tubular members (10, 11', 12', 13') two of which are intermediate members (11', 12') with their pulley wheel and endless loop systems lodged in respective longitudinal half sections of the tubular members, and said fluted shaft (104) being disposed to one side where the two half sections meet.

6. An isolating switch according to claim 1, wherein the mechanical means for displacing the intermediate member (11') adjacent to the base member (10) comprise an endless loop (303) passing over two pulley wheels (301, 302), said intermediate member being fixed to a point on said endless loop, and a drive motor driving one of said pulley wheels in rotation.

7. An isolating switch according to claim 1, wherein the base member (10) includes a socket (103) serving as a base plate and wherein the base member (10) and the intermediate members (11') which are not adjacent to the end member (13') each include a post (105, 115) placed inside and parallel to a generator line, with one end fixed to its socket (103, 113) and with its other end being attached to the endless loop of the next nearer member to the end member (13').

8. An isolating switch according to claim 7, wherein the end member (13') includes a socket (133) fixed to its end nearest to the base member (10) and wherein its socket (133) and the sockets of the intermediate members (12') which are not adjacent to the base member (10) are each fixed to the endless loop of the adjacent intermediate member (11', 12') nearer to the base member (10).

9. An isolating switch according to claim 1, further including means (320, 322) for fixing a conductor tube (12) to the drive member (12') associated therewith.

10. An isolating switch according to claim 9, wherein said fixing means comprise bands (323, 324) held in place by rings (320, 322) which are clamped together.

11. An isolating switch according to claim 1, wherein the mechanical displacement means comprises a fluted rotary shaft (104) fixed for rotation about its axis inside the base member (10) along a generator line, a drive motor reduction gear unit (8) operatively connected to said fluted rotary shaft, a gear system slidably mounted on the fluted rotary shaft (104) and engaging one of the pulley wheels (110) of the mechanical link means of the intermediate member (12') adjacent to the base member (10) for rotating said one pulley wheel.

12. An isolating switch according to claim 14, wherein the socket (113) of the intermediate member (11') adjacent to the base member (10) supports a gear system for coupling the nearest pulley wheel (110) to the rotary shaft (104).

13. An isolating switch according to claim 12, wherein the gear system comprises a 45° bevel gear wheel (118) mounted on the end of the pulley wheel (110) axis, a return gear (119) mounted through the socket (113) and having a 45° bevel first toothed portion (212) engaging the bevel gear wheel, and a second toothed portion (213) engaging a second gear wheel (214) slidable along the fluted shaft (104), which is rotatable thereby and which is keyed to the socket (113).

* * * * *